United States Patent [19]

Acker et al.

[11] Patent Number: 4,846,266

[45] Date of Patent: Jul. 11, 1989

[54] HEADER ASSEMBLY FOR PLATE-TYPE EVAPORATIVE HEAT EXCHANGERS

[75] Inventors: Robert M. Acker, Englewood; John P. Madron, Thornton, both of Colo.

[73] Assignee: Norsaire Systems, Denver, Colo.

[21] Appl. No.: 242,147

[22] Filed: Sep. 9, 1988

[51] Int. Cl.[4] ..... B22D 13/00

[52] U.S. Cl. ..... 165/115; 239/145; 239/568; 261/99; 261/103

[58] Field of Search ..... 165/115; 137/338; 239/145 X, 462, 553, 553.3, 553.5, 557, 568 X; 261/99 X, 103 X, 106, 110

[56] References Cited

U.S. PATENT DOCUMENTS

| | | | |
|---|---|---|---|
| 3,075,750 | 1/1963 | Goettl | 261/97 |
| 4,159,291 | 6/1979 | Bruckert et al. | 261/97 |
| 4,657,709 | 4/1987 | Goettl | 261/106 |

*Primary Examiner*—Noah P. Kamen
*Attorney, Agent, or Firm*—Carl Schaukowitch

[57] ABSTRACT

A header assembly comprises a plurality of substantially V-shaped, slotted troughs disposed in a substantially parallel relationship and interconnected perpendicularly to a manifold. Each trough comprises two substantially parallel, rigid side walls, two rigid end plates and two oblique walls which converge and attach to define an apex of the V-shaped trough. A plurality of alternating spacing elements and slots extends longitudinally along the length of the trough and equidistantly and obliquely along both oblique walls at the apex of the trough. Each trough contains a fiberglass-woven cord extending along the length of the trough and is disposed above the spacing elements and slots and in contact with both oblique walls.

5 Claims, 4 Drawing Sheets

HEADER ASSEMBLY FOR PLATE-TYPE EVAPORATIVE HEAT EXCHANGERS

BACKGROUND OF THE INVENTION

This invention relates to a new and improved header assembly for plate-type evaporative heat exchangers.

Many state-of-the-art, plate-type, evaporative heat exchangers incorporate very thin aluminum sheets as the plate material. These plates are attached alternately along opposite edges to form a cross-flow heat exchanger. Most of these heat exchangers have a wicking material or a wettable material laminated to one surface of the plate. These material surfaces of the plates define the evaporative cooling channels. Although the thinness of the aluminum plates provides improved heat exchange, the pliability of these thin plates often results in uneven spacing of the openings into the evaporative cooling channels between the edges of the attached plates. Therefore, during operation, more water is distributed onto some of the evaporative cooling surfaces than others, while simulataneously, more secondary air is blown through some of the evaporative cooling channels than others. This uneven distribution of water and air entering into the evaporative cooling channels results in diminished heat exchange.

Typically, sprinkler heads are used to supply water onto the evaporative cooling surfaces of the state-of-the-art heat exchangers. Sprinkler heads for evaporative heat exchangers are undesirable for several reasons. First, the water spray humidifies the secondary air before it enters into the evaporative cooling channels. Humidified secondary air is counterproductive for evaporative cooling purposes. Second, due to the spray pattern of the water over the heat exchanger, sprinkler heads inherently cannot uniformly distribute water onto the evaporative cooling surfaces. In addition to the spray pattern, the number and arrangement of the sprinkler heads further complicate uniform water distribution. Third, the sprinkler heads spray water from small orifices that might clog with impurities or debris which might accumulate during the recirculation of the unevaporated water. Fourth, spraying water from small orifices requires relatively high pump horsepower to overcome the pressure loss incurred at the orifices of the sprinkler heads.

It is from these considerations and others that the present invention evolved.

SUMMARY OF THE INVENTION

The present invention provides significant improvements and advantages over prior art header assemblies for plate-type evaporative heat exchangers, particularly, with its inherent characteristics to provide substantially even spacing between the plates defining the evaporative cooling channels, to distribute water in a substantially uniform manner onto the evaporative cooling surfaces without humidification of the secondary air before it enters the evaporative cooling channels and to filter impurities and debris from the recirculated water.

The header assembly comprises a plurality of substantially V-shaped, slotted troughs disposed in a substantially parallel relationship and interconnected perpendicularly to a manifold. A fiberglass woven cord lays within and along the entire length of each trough. The manifold perpendicularly intersects the plurality of troughs to provide water for each trough from a common water source.

Each trough comprises two substantially parallel, rigid side walls, two rigid end plates and two oblique walls which converge and attach to define an apex of the V-shaped trough. A plurality of alternating spacing elements and slots extends longitudinally along the length of the trough and equidistantly and obliquely along both oblique walls at the apex of the trough. Each trough contains a fiberglass-woven cord extending along the length of the trough and is disposed above the spacing elements and slots and in contact with both oblique walls defining the V-shaped channel of the trough.

The present invention is described and shown in greater specificity in drawings and the following description of the preferred embodiment. Comprehension of the various aspects of the invention should lead to an increased appreciation for the significance of the invention and its advancement over the prior art.

BRIEF DESCRIPTION OF THE DRAWINGS

Other objects, advantages and capabilities of the present invention will become more apparent as the description proceeds, taken in conjunction with the accompanying drawings in which.

DESCRIPTION OF THE PREFERRED EMBODIMENT

Figure 1:
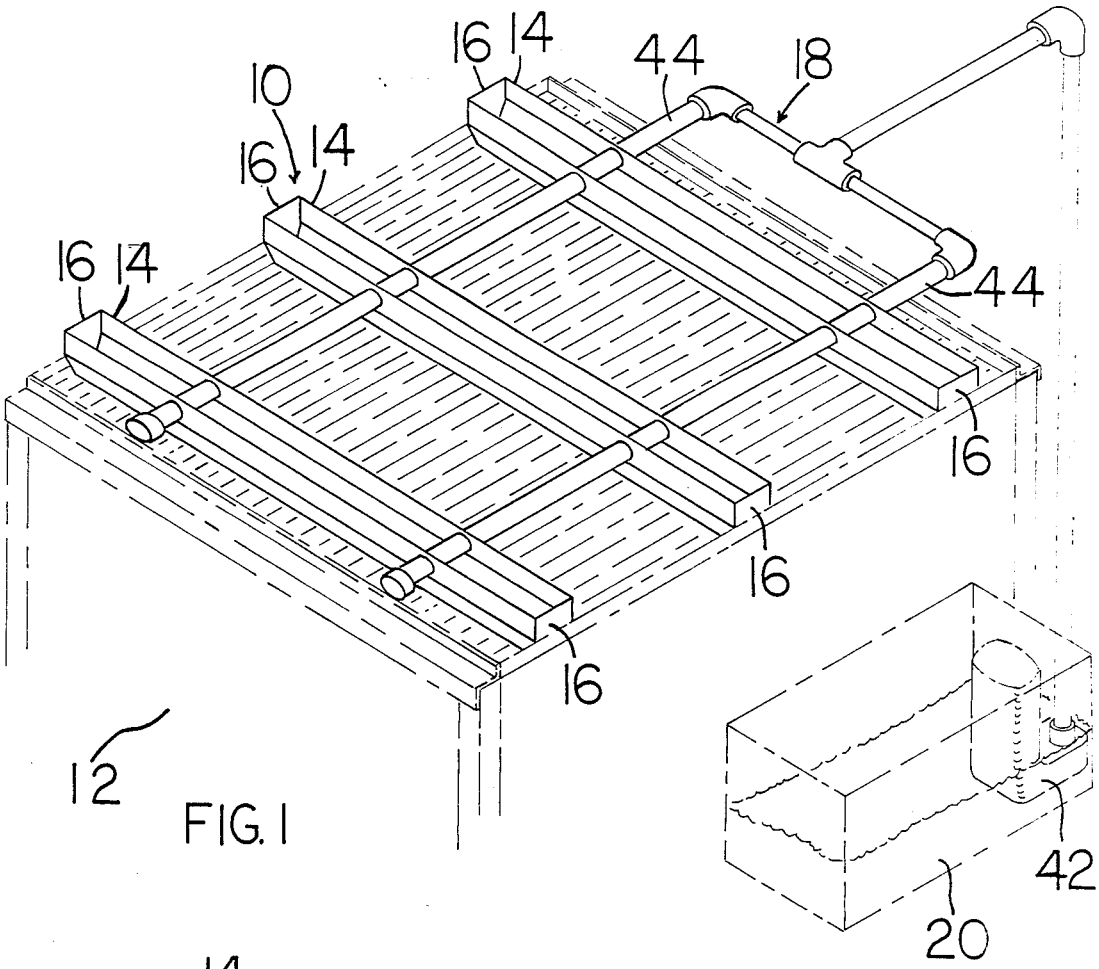
FIG. 1 is a perspective view of the new and improved header assembly installed onto a phantomly-drawn, prior art plate-type, cross-flow evaporative heat exchanger.

The present invention is generally introduced in FIG. 1 in which a header assembly 10 is installed onto a phantomly-drawn, prior art, plate-type, cross-flow evaporative heat exchanger 12. Three V-shaped troughs 14 are disposed in a substantially parallel manner and extend across the top of the prior art evaporative heat exchanger 12. The three troughs 14, each having end plates 16 attached at opposite ends, are integrally interconnected by a dual-pipe manifold 18 which supplies water or other liquid to each trough 14 from a common source 20.

Figure 3:
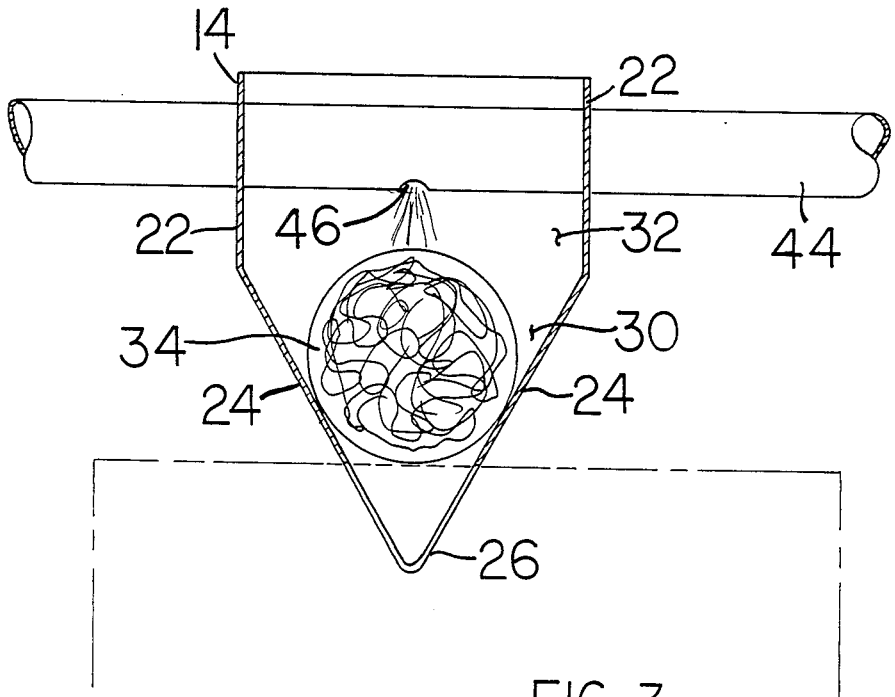
FIG. 3 is a front evaporational view of the trough shown in FIG. 2.
Figure 2:
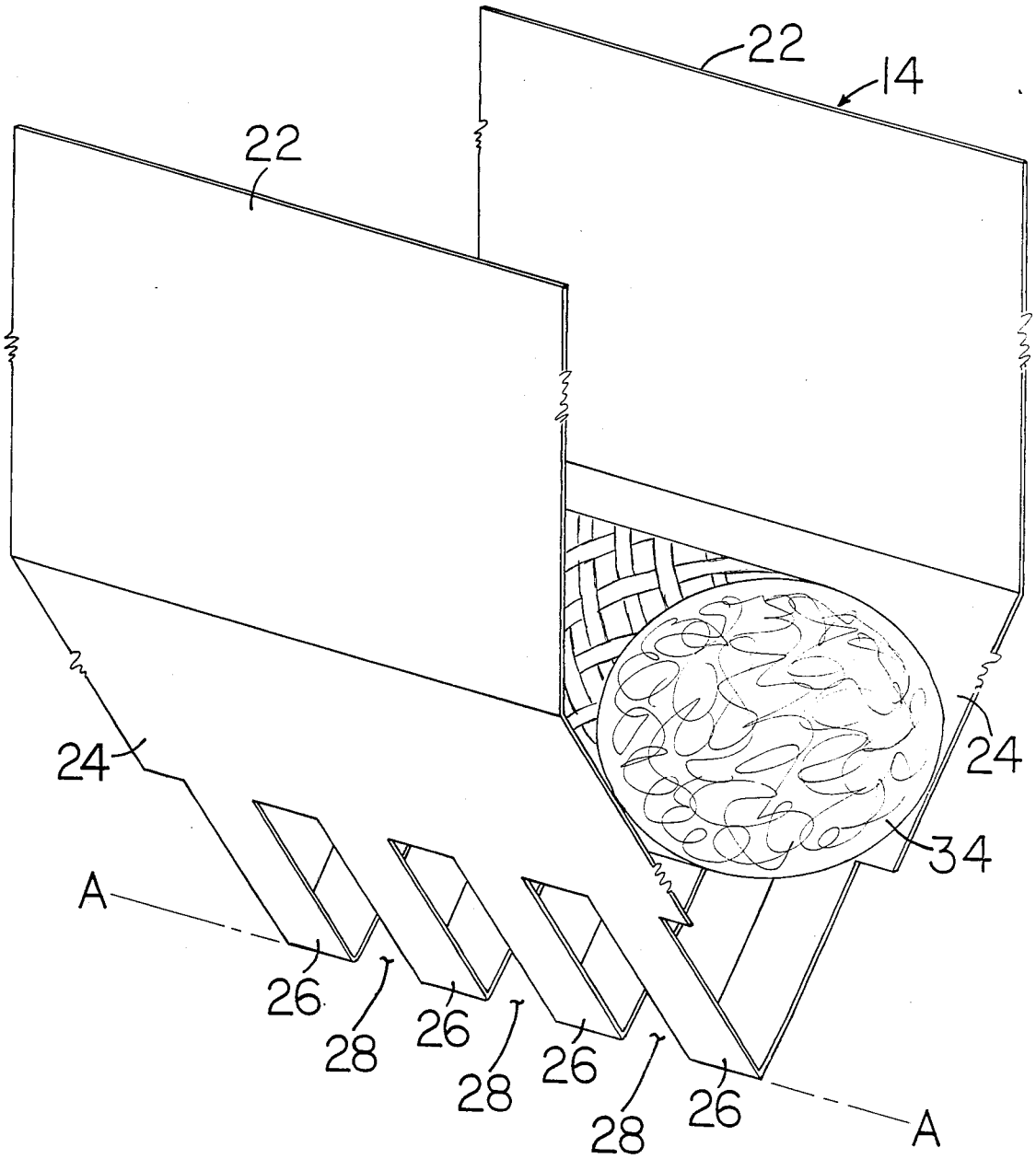
FIG. 2 is a partial, exploded perspective view of the trough of the present invention shown in FIG. 1.

As best shown in FIG. 2, each trough 14 fabricated from a rigid material such as sheet metal, aluminum or plastic has two opposite, parallel side walls 22, two oblique walls 24 converging toward a common apex A—A and a plurality of V-shaped spacing elements 26 separated therebetween by slots 28. In FIG. 3, the V-shaped spacing elements 26 are rigidly attached to the oblique walls 24 to define a substantially V-shaped channel 30; the oblique walls 24 are rigidly attached to the side walls 22 to define a U-shaped channel 32 positioned immediately above the V-shaped channel 30.

Shown in both FIGS. 2 and 3, a fiberglass-woven cord 34 lays in contact with both oblique walls 24 and, therefore, is easily removable. The fiberglass-woven cord 34 extends along the entire length of the V-shaped trough 14. As best shown in FIG. 3, the bottom-most portion of the cord 34 extends to either the bottom-most portion of the oblique walls 24 or slightly thereabove. At least a substantial portion of the cord 34 must be disposed above the spacing elements 26 and slots 28.

Figure 4:
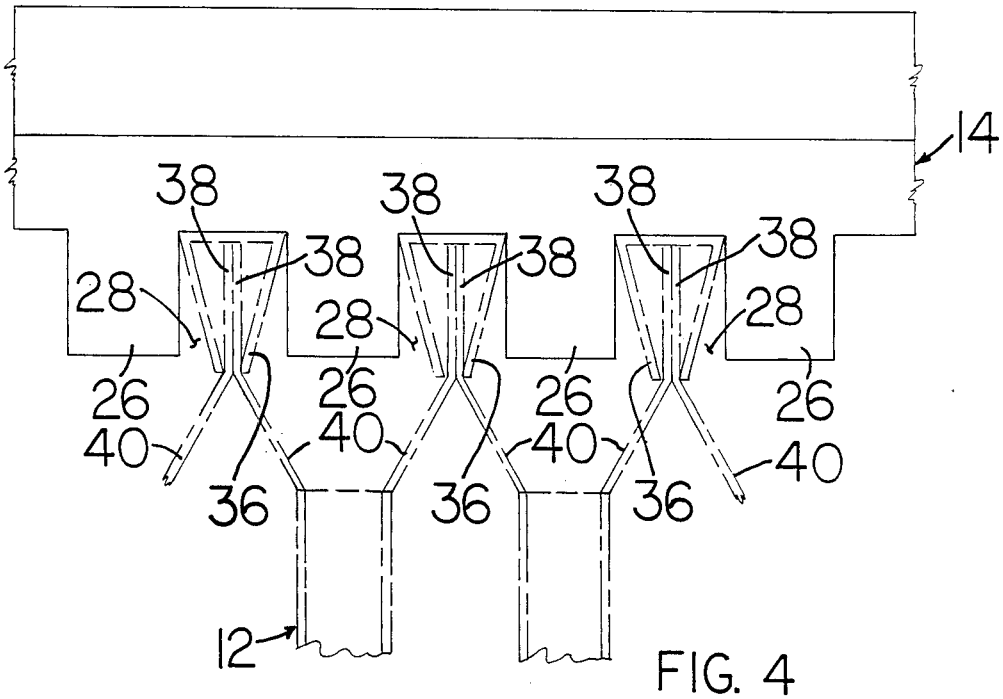
FIG. 4 is a side elevational view of the trough shown in FIG. 3.

In FIG. 4, each slot 28 of the trough 14 receives a triangular-shaped clamp 36 which retains two edges 38 of two plates 40 forming evaporative cooling channels (not shown) of the evaporative heat exchanger 12. The spacing elements 26 and alternating slots 28 provide rigid attachment of the header assembly 10 to the prior art heat exchanger 12 as well as substantially uniform spacing between and among the clamps 36 retaining the edges 38 of the plates 40. This substantially uniform spacing between and among all of the clamps 36 affords substantially even distribution of secondary air when it is blown into the evaporative cooling channels. Thus, improved evaporative cooling results.

FIG. 1 depicts the general operation of the header assembly 10 as it is attached to a prior art, plate-type, cross-flow heat exchanger 12. Water (not numbered) is pumped by a sump pump 42 from a common water source 20 into the dual-piped manifold 18 to supply water to the troughs 14. As best shown in FIGS. 1 and 3, each pipe 44 of the dual-pipe manifold 18 which is disposed above the cord 34 extends substantially perpendicular through each side wall 22 of the troughs 14 to provide liquid communication between the common water source 20 and the troughs 14. In FIG. 3, a hole 46 in the bottom portion of the pipe 44 allows water to flow from the pipe 44, into the trough 14 and onto the fiberglass-woven cord 34. The fiberglass-woven cord 34 inhibits the flow of the water in a manner to cause the water to be distributed substantially evenly throughout the entire length of the trough 14 above the fiberglass-woven cord 34 while it simultaneously flows therethrough. As the water flows through the fiberglass-woven cord 34, the water is filtered from impurities and debris without increasing the pumping horsepower requirements. Furthermore, since the water is substantially evenly distributed throughout the entire length of the trough 14, a substantially equal amount of water flows into the lower portion of the V-shaped channel 30. Thus, water is substantially equally distributed at each slot 28 onto the evaporative cooling surfaces of each plate without humidifying the secondary air.

Figure 5:
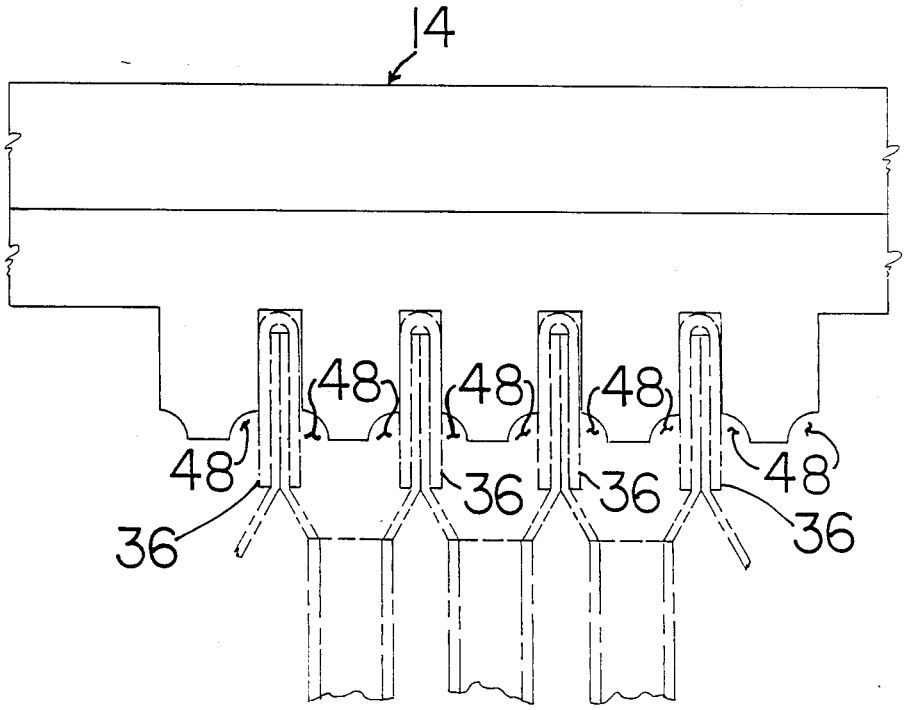
FIG. 5 is a side elevational view of an alternative embodiment of the trough of the present invention as shown in FIG. 4.
Figure 6:
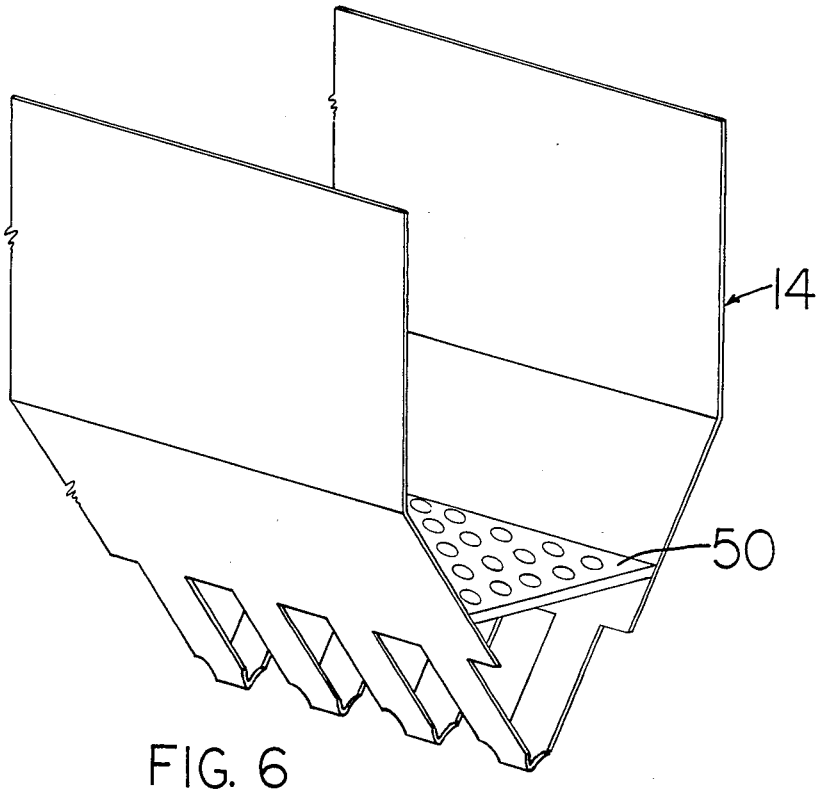
FIG. 6 is a partial, exploded perspective view of an alternative embodiment of the trough of the present invention shown in FIG. 2.
Figure 7:
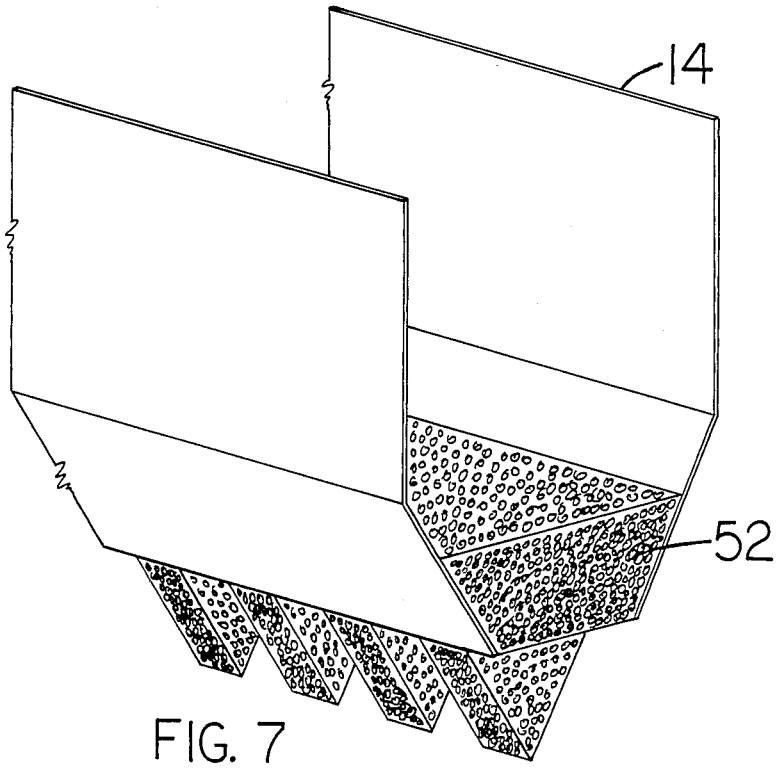
FIG. 7 is a partial, exploded perspective view of an alternative embodiment of the trough of the present invention shown in FIG. 2.

FIGS. 5, 6 and 7 depict alternative embodiments of the present invention.

The alternative embodiment of FIG. 5 enables the trough 14 to received U-shaped clamps 36. Notches 48 are formed into the spacing elements to facilitate the flow of water from the trough 14 and into the evaporative cooling channels.

The alternative embodiment of FIG. 6 is substantially identical to the preferred embodiment except, that instead of utilizing a fiberglass-woven cord 34 to filter and distribute the water substantially evenly throughout the upper portion of the trough 14, a grate 50 is used. The grate 50 may be removed for cleaning and replaced thereafter.

The alternative embodiment of FIG. 7 comprises the identical side walls and oblique wall of the present invention. However, instead of using a fiberglass-woven cord 34 or a grate 50, a porous plastic material 52 is used. One type of porous plastic material is manufactured by Porex Technologies Corp. of Fairburn, Ga., which bears the tradename, Porex. The porous plastic material 52 is formed in a V-shape to lay in contact with the oblique walls of the trough and within the upper portion of V-shaped channel of the trough. Slots are formed into the porous material 52 to provide uniform spacing between the attached edges of the plates forming the evaporative cooling channels. Due to the porosity in the porous plastic material 52, the flow of water is inhibited to substantially distribute evenly throughout the trough 14 above the porous material 52 and the water can flow through the porous spacing elements and into the evaporative cooling channels.

It should be understood that the preferred embodiment has been described as a header assembly with a dual-pipe manifold and three troughs. However, not by way of limitation, the header assembly can be fabricated with one or more troughs with a manifold having a single pipe or multiple pipes.

The preferred embodiment of the present invention and its significant advantages and advancements over prior art have been described with a degree of specificity of description. It should be understood, however, that the specificity of description has been made by way of example only and that the scope of the invention falls within the scope of the appended claims.

We claim:

1. A header assembly for distributing a liquid, comprising:

at least one substantially V-shaped trough having a length extending along an apex, said trough being formed with a plurality of alternating spacing elements and slots disposed along said apex;

a manifold comprising at least one pipe having at least one hole therethrough, said pipe being integrally attached substantially perpendicularly to said trough; and a means to inhibit liquid flow, said means being removably attached onto and within said trough and substantially disposed above said spacing elements and said slots and below said pipe whereby said liquid enters into said trough through said hole in said pipe and flows onto said means to inhibit liquid flow thereby simultaneously causing said liquid to be distributed substantially evenly throughout said length of said trough and to flow through said means, onto said spacing elements and through said slots.

2. A header assembly as defined in claim 1, whereby: said plurality of alternating spacing elements and slots are disposed equidistantly along said apex.

3. A header assembly as defined in claim 1, whereby: said means to inhibit liquid flow is a cord.

4. A header assembly as defined in claim 3, whereby: said cord is woven fiberglass material.

5. A header assembly as defined in claim 1, whereby: said means to inhibit fluid flow is a grate.

* * * * *